US009997857B2

(12) United States Patent
Theuwis et al.

(10) Patent No.: US 9,997,857 B2
(45) Date of Patent: Jun. 12, 2018

(54) PLUG BRIDGE, AND METHOD FOR PRODUCING A PLUG

(71) Applicant: BIZLINK TECHNOLOGY (SLOVAKIA) S.R.O., Trencianska Tepla (SK)

(72) Inventors: Josse Theuwis, Overpelt (BE); Juraj Slavik, Ilava (SK); Rainer Sessner, Roth (DE)

(73) Assignee: Bizlink Technology (Slovakia) s.r.o., Trencianska Tepia (SK)

( * ) Notice: Subject to any disclaimer, the term of this patent is extended or adjusted under 35 U.S.C. 154(b) by 32 days.

(21) Appl. No.: 15/166,911

(22) Filed: May 27, 2016

(65) Prior Publication Data

US 2016/0276771 A1 Sep. 22, 2016

Related U.S. Application Data

(63) Continuation of application No. PCT/EP2014/075124, filed on Nov. 20, 2014.

(30) Foreign Application Priority Data

Nov. 27, 2013 (DE) ..... 10 2013 019 725

(51) Int. Cl.
*H01R 13/405* (2006.01)
*H01R 43/24* (2006.01)
(Continued)

(52) U.S. Cl.
CPC ..... *H01R 13/405* (2013.01); *H01R 4/18* (2013.01); *H01R 13/447* (2013.01);
(Continued)

(58) Field of Classification Search
CPC ..... H01R 13/506; H01R 13/405; H01R 2103/00; H01R 13/504; H01R 13/47; H01R 24/28
See application file for complete search history.

(56) References Cited

U.S. PATENT DOCUMENTS 7,241,165 B2 7/2007 Scheer et al.
7,354,310 B1 4/2008 Brown
(Continued)

FOREIGN PATENT DOCUMENTS

CN 101055959 A 10/2007
CN 202662933 U 1/2013
(Continued)

*Primary Examiner* — Briggitte R Hammond
(74) *Attorney, Agent, or Firm* — Laurence A. Greenberg; Werner H. Stemer; Ralph E. Locher

(57) ABSTRACT

In order to allow conductors to be connected to a plug bridge in a simple manner, the plug bridge has a support to which a plurality of contact pins and also a plurality of conductor connections which are electrically conductively connected to, in each case, one contact pin are fastened. The support contains a housing which, together with the conductor connections, is covered by a common dimensionally stable and inherently rigid cover part in a closed state. The cover part has, in the region of the conductor connections, separating webs which extend between the conductor connections in the closed state. The entire dimensionally stable cover part can be moved from an open position to a closed position in a pivotable manner on the support.

16 Claims, 3 Drawing Sheets

(51) Int. Cl.

| | |
|---|---|
| ***H01R 13/447*** | (2006.01) |
| ***H01R 13/506*** | (2006.01) |
| ***H01R 24/30*** | (2011.01) |
| ***H01R 4/18*** | (2006.01) |
| ***H01R 13/504*** | (2006.01) |
| *H01R 103/00* | (2006.01) |

(52) U.S. Cl.
CPC ..... *H01R 13/504* (2013.01); *H01R 13/506* (2013.01); *H01R 24/30* (2013.01); *H01R 43/24* (2013.01); *H01R 2103/00* (2013.01)

(56) References Cited

U.S. PATENT DOCUMENTS

| | | | |
|---|---|---|---|
| 2005/0159047 | A1 | 7/2005 | Takahashi |
| 2007/0232117 | A1 | 10/2007 | Singer |

FOREIGN PATENT DOCUMENTS

| | | | |
|---|---|---|---|
| DE | 19511410 | A1 | 10/1996 |
| DE | 202005018318 | U1 | 4/2007 |
| EP | 1843435 | A2 | 10/2007 |
| GB | 2127628 | A | 4/1984 |
| GB | 2370163 | B | 5/2005 |
| WO | 02089259 | A2 | 11/2002 |

PLUG BRIDGE, AND METHOD FOR PRODUCING A PLUG

CROSS-REFERENCE TO RELATED APPLICATION

This is a continuation application, under 35 U.S.C. § 120, of copending international application No. PCT/EP2014/075124, filed Nov. 20, 2014, which designated the United States; this application also claims the priority, under 35 U.S.C. § 119, of German patent application No. DE 10 2013 019 725.2, filed Nov. 27, 2013; the prior applications are herewith incorporated by reference in their entirety.

BACKGROUND OF THE INVENTION

Field of the Invention

The invention relates to a plug bridge and also to a method for producing a plug containing a plug bridge of this kind.

A plug bridge of this kind can be found in British patent GB 2 370 163 B.

Plug bridges are used during the production of mains plugs and contain a plastic support on which contact pins are held on one side. The contact pins are electrically conductively connected by contact tabs to conductor connections, in particular crimp connections, to which conductors of a cable which are stripped of insulation are connected. After the conductors are connected, the plug bridge is further surrounded by a casting compound.

The mains plugs have country-typical configurations and are subject to country-specific standards in each case. The country-specific plug for Great Britain, called GB plug in the text which follows, has an integrated electrical fuse element.

A plug bridge for a GB plug of this kind can be found in British patent GB 2 370 163 B. The plug bridge contains a housing in which the fuse element is accommodated. One of the conductor connections is connected to the contact pin which is associated with it by the fuse element. The housing is closed by a cover on which an additional protection element is integrally formed by a film hinge, the additional protection element having separating webs which engage between conductor connections which are adjacent to one another. In order to make contact with the conductors, in particular with the aid of a crimping process, the protection element is swung upward out of the way in order to allow improved accessibility to the conductor connections.

Mains plugs of this kind are mass-produced goods, it being desirable to produce the goods in as cost-effective, reliable and problem-free and simple a manner as possible.

SUMMARY OF THE INVENTION

Proceeding from the above, the object of the invention is to specify a plug bridge which allows simple, cost-effective and reliable production of a mains plug.

The advantages and preferred refinements cited in respect of the plug bridge can analogously also be transferred to the method.

The plug bridge contains a support which is composed of an insulating material and to which a plurality of contact pins and a plurality of conductor connections which are electrically conductively connected to in each case one contact pin are fastened. The support forms a housing. The conductor connections are arranged on the edge of the housing. The housing and the conductor connections are covered by a common, dimensionally stable and inherently rigid cover part in a closed state. The cover part has separating webs in the region of the conductor connections, and the separating webs extending between the conductor connections in the closed state. In this case, the cover part is arranged on the housing such that it can pivot, so that it can be moved from an open position, in which both the housing is open and the conductor connections are freely accessible, to the closed position during mounting. In this case, when the cover part is pivoted to the closed position, the housing is firstly closed and, at the same time, the separating webs are inserted between the conductor connections. The cover part therefore covers both the housing together with the components arranged therein, in particular at least one fuse element, and also the conductor connections which are arranged at the edge next to the housing and is in the form of a rigid component without sub regions which move relative to one another. Chambers which are separated from one another are usually formed within the housing, the chambers therefore being covered by the cover part together with the conductor connections.

The configuration of the cover part as an inherently rigid, dimensionally stable part without moving components has proven particularly process-reliable on account of the ability to withstand high mechanical loads. Furthermore, accessibility is also improved overall since the pivot axis is at a great distance from the conductor connections on account of the cover part being mounted, in particular, in a rear region of the housing. The cover part is positioned at a great distance from the conductor connections in the open position, and therefore easy accessibility to the conductor connections is ensured.

In an expedient development, at least one articulation element is integrally formed on the housing, and the cover part is snapped onto the articulation element. Simple production of the cover part as a separate element and simple prefabrication are possible as a result. To this end, articulation elements which are in the form of articulation pins in particular are integrally formed laterally on the housing, corresponding bearing eyelets of the cover part engaging around the articulation elements. In this case, the bearing elements are formed, in particular, at the top, rear edge of the housing. In this case, the pivot axis runs along a rear side wall of the housing. As a result, the pivot axis is fixedly defined in its position and it is ensured that the cover part is fixedly seated on the housing. This is also of particular significance in respect of sealing. In addition, this makes the configuration robust overall, this being advantageous in terms of processing.

In a preferred alternative refinement, the cover part is formed in one piece with the housing and not as a separate, loose part. In this case, the cover part is a common injection-molded part together with the housing and the entire support in which only the electrical components, such as conductor connections, contact pins and fuse elements, have to be accommodated. As a result, a separate production step for the cover part is dispensed with, this therefore leading to simplification of the structural and production-related complexity overall.

In this case, the cover part is expediently connected to the housing by a material bridge, wherein the material bridge allows pivoting. The material bridge is formed, for example, by an indentation in the region of the desired pivot axis.

In a preferred refinement, the material bridge is now formed in such a way that the cover part is fixed and held in the open position as mounting position by the material bridge itself. During production of the support with the integrally formed cover part as an injection-molded part, the cover part is therefore produced in the open position and also fixed and held therein by the material bridge. This is to be understood to mean that a sufficient fixing force is formed by the material bridge, so that the cover part also remains in the open position during transportation or movement of the support and can be moved to the open position at a contact-making station (crimping station) without the cover part covering the conductor connections. The cover part is therefore held in a defined mounting position by the material bridge, the defined mounting position ensuring that the conductor connections are freely accessible.

In this case, the fixing is expediently irreversible and therefore can be released only once, so that the cover part can be pivoted to the closed position. Returning the cover part to the open position does not lead to the cover part being fixed in the open position once again.

According to a first variant embodiment, only a, for example v-shaped, notch for defining the pivot axis and the material bridge is made in this case. Owing to the elasticity and plasticity of the plastic used, the fixing by the material bridge can be broken on the one hand, and at the same time the material bridge further acts as a kind of hinge or articulation. In an alternative variant embodiment, holding webs for example are formed between the housing and the cover part for fixing in the open position, the holding webs being destroyed when a closing force is exerted. The closing force is generally exerted, for example by machine or else manually, for the purpose of closing the cover part after the lines are connected to the conductor connections.

In a preferred development, the cover part can be locked in its open position for mounting the conductors. To this end, the cover part can preferably be latched to the housing, wherein the latching connection can be released by a force being exerted. Owing to this measure, the support can therefore be pre-fitted with the cover part and, in the closed position, can be moved onto the mounting path for the purpose of making contact with the cable. The cover part is moved to the open position for contact-making purposes. Locking in the open position ensures easy accessibility and prevents the cover part from falling down. Therefore, additional holding measures on the mounting path, in particular on the crimping machine, are not required.

According to an expedient development, it is further provided that the cover part can be latched to the housing in its closed position for the purpose of preventing pivoting. In this case, latching is preferably performed on that edge side of the housing which is opposite the pivot axis. Therefore, the cover part is fixed in its position. This prevents the cover part from being pushed out of its desired defined position during subsequent encapsulation of the plug bridge by casting or injection molding.

In respect of positioning in as exact a manner as possible, a positioning element is expediently integrally formed on the cover part, the cover part being routed and held in a defined position in relation to the housing by the positioning element. An interlocking connection which acts in the lateral direction is formed by the positioning element, so that a lateral offset of the cover part on the housing is avoided. In this case, the positioning element is formed, in particular, on the bottom face of the cover part and engages in a second positioning element on the housing.

In this case, the second positioning element is preferably a fixing pin with which a contact tab which is situated in the housing is also fixed in the desired position at the same time. In this case, the contact tab is associated with one of the conductor connections and connected to the conductor connection. The conductor connections with the contact tabs connected to them are usually bent and stamped sheet-metal parts, in particular composed of copper. In this case, the conductor connections are formed from a crimping region to which a contact tab which is usually also bent several times is connected. Some of the contact tabs are routed through the housing. The conductor connections together with the contact tabs form a contact element in each case, the contact element providing the electrical contact connection between the conductor which is to be connected and the contact pins.

The first positioning element, which is formed on the cover part, is formed, in particular, as a closed hat-like cap. Owing to the closed design, the cover part is not interrupted and is therefore sealed off in the region of the positioning element.

The plug bridge usually has three contact elements with the conductor connections and has three contact pins. While the first conductor connection is directly connected by a contact tab to the contact pin which is associated with it, the second conductor connection is connected by a fuse element, which is situated in the housing, to the contact pin which is associated with it. Finally, the third conductor connection is connected to the third contact pin. The three contact pins are arranged in triangular form in accordance with the GB standard. In this case, the three conductor connections are arranged such that they are situated directly next to one another. The right-hand-side, third conductor connection is connected by a contact tab to the rear contact pin through the housing. To this end, the right-hand-side contact element is simply inserted from above when the housing is open. Particularly in the case of this third contact element, a latching or holding element is now further formed on the housing in an expedient refinement, the latching or holding element holding the third contact element, in particular the contact tab which adjoins the conductor connection, in the desired mounting position in the manner of a holding-down means. In this case, the support has a guide in which the contact element, in particular the contact tab, is inserted. In this case, lug-like latching elements are formed on the edge of the walls of the guide, the lug-like latching elements engaging behind the contact tab in an interlocking manner when the contact element is inserted. This reliably prevents the contact element together with the cover part being lifted upward when the cover part is opened.

Under unfavorable conditions, there is a risk of water entering the housing. In a preferred embodiment, the housing and the cover part have a channel/sealing web pair for reliable sealing-off, wherein the sealing web engages in the channel in line with the tongue-and-groove principle in the closed position. Reliable sealing-off is achieved as a result. In this case, the channel and the sealing web are arranged at least virtually circumferentially around a respective chamber which is formed by the housing in the cover. In this case, an approximately U-shaped configuration is expediently formed, wherein the channel is expediently open and exits from the side wall on that side which is situated opposite the conductor connections. The housing typically forms two chambers which are situated opposite one another and are separated by a central region. A channel is expediently formed around each of the chambers. The chambers are therefore each separately sealed off by the channel/sealing web system.

Instead of this tongue-and-groove principle, the arrangement of elastic sealing fins is provided according to a further preferred variant, the arrangement sealing off the separating plane between the housing and the cover part.

In an expedient refinement, the cover part is connected to the housing in a circumferentially cohesive manner in the finally assembled state. This likewise serves for secure and reliable sealing-off. In this case, the cohesive connection is made, for example, with the aid of a welding process, in particular ultrasonic welding. After the conductors are connected, the cover part is closed and then welded to the housing.

According to a preferred development, the cover part is mounted on the housing in such a way that it not only executes a purely circular movement about a pivot axis but rather a linear partial movement, specifically immediately in the region of the closed position, additionally takes place too. The cover part is therefore routed parallel to a housing surface immediately before reaching the closed position during closing. As a result, it is ensured, in particular in the case of the refinement with the channel and the sealing web, which the sealing web is mounted and engages in the channel in a plane-parallel manner. During the opening process, the movement takes place in an identical manner in the opposite direction. This superimposed movement sequence is achieved, for example, by corresponding mounting of the cover part on the housing. In particular, slotted guide-like elongate hole guides are formed for an articulation pin, so that a superimposed movement sequence is achieved. As an alternative, eccentric mounting is also possible.

The support preferably has a support plate which projects beyond the edge of the housing. The support is in the form of an injection-molded plastic part overall and contains the support plate and the housing. In order to ensure reliable and secure attachment of the casting compound, the carrier plate has passage holes in the edge of the housing, the casting compound passing through the passage holes in the mounted end state. The casting compound is usually a material which is different from the material of the support and which does not necessarily form a cohesive connection with the support. By way of example, PBT (polybutylene terephthalate) is used for the support, and a PVC (polyvinyl chloride) is used for the casting compound.

On that side which is situated opposite the conductor connections, the support plate has a projecting, preferably triangular, edge region in which one of the contact pins is positioned. In addition, the triangle tip of the carrier plate at the end is expediently flattened and an approximately V-shaped notch is made in this flattened region. In addition, the notch serves likewise to securely fix the casting compound, in particular when it is removed from a mold.

Other features which are considered as characteristic for the invention are set forth in the appended claims.

Although the invention is illustrated and described herein as embodied in a plug bridge, and a method for producing a plug, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
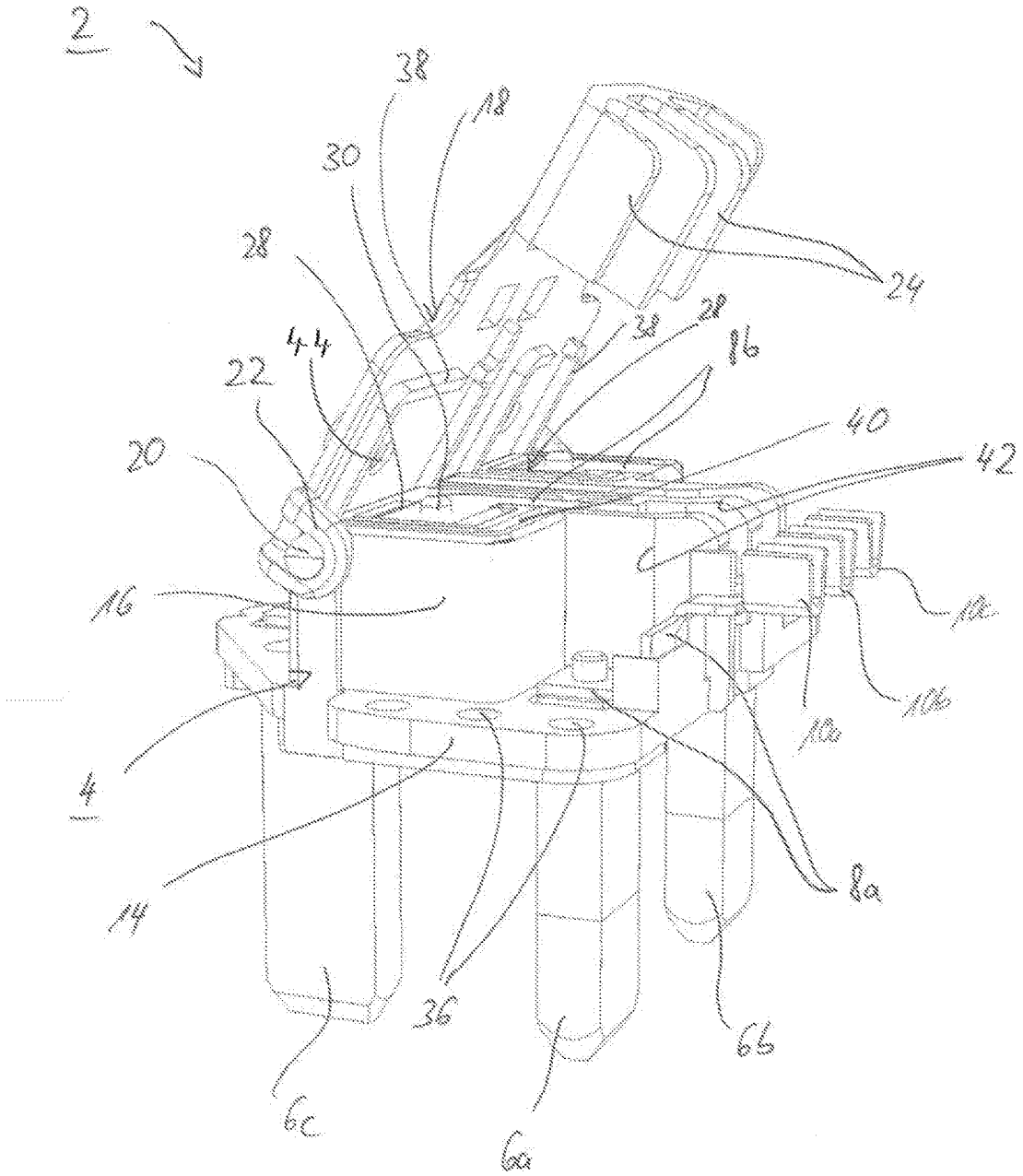
FIG. 1 is a diagrammatic, perspective view of a plug bridge when a cover part is open according to the invention.

Identically acting parts are in each case provided with the same reference symbols throughout the figures. Referring now to the figures of the drawings in detail and first, particularly to FIG. 1 thereof, there is shown a plug bridge 2 configured for producing a GB-compatible mains connection plug. The plug bridge 2 contains a support 4, three contact pins 6*a*, 6*b*, 6*c*, three contact elements and a cover part 18. The contact elements each have a conductor connection which is in the form of a crimp connection 10*a*, 10*b*, 10*c*, in each case one contact tab 8*a*, 8*b*, 8*c* adjoining the conductor connection and the contact tab being connected to in each case one of the contact pins 6*a*, 6*b*, 6*c*. The contact elements are bent and stamped sheet-metal parts, in particular composed of copper. The support 4 once again contains a support plate 14 with a formed housing 16. The support plate 14 and the housing 16 form a single-piece injection-molded plastic part.

Furthermore, the plug bridge 2 has the cover part 18 which closes the housing 16 at the top and which is in the form of a separate injection-molded part in the exemplary embodiment. In this case, the cover part 18 is in the form of a dimensionally stable, inherently rigid element which does not have any moving parts. As a result, the cover part is particularly robust and it is ensured, in particular, that the cover part 18 bears on the housing in a reliable and sealing manner. The cover part 18 is held on the housing 16 in a pivotable manner by an articulation connection. To this end, bearing pins 20 are integrally formed on the edge of the housing 16 in the rear region of the housing, a corresponding bearing eyelet 22 of the cover part 18, which bearing eyelet is approximately right-angled, engaging around the bearing pins in each case. The bearing eyelet 22 has a certain degree of elasticity, so that it can be snapped onto the bearing pin 20 by being pressed down during mounting of the cover part 18, so that the bearing eyelet 22 latches with the bearing pin 20. To this end, the bearing pin 20 has a run-on bevel at the top.

Figure 2:
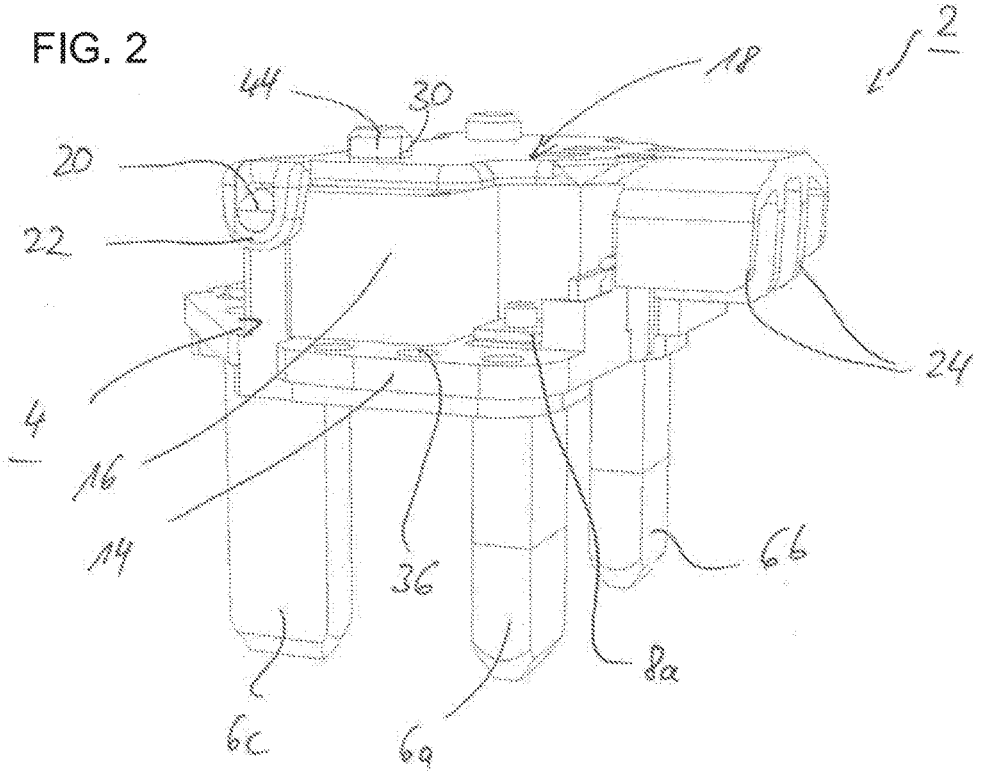
FIG. 2 is a perspective view of the plug bridge according to FIG. 1 with the cover part closed.
Figure 3:
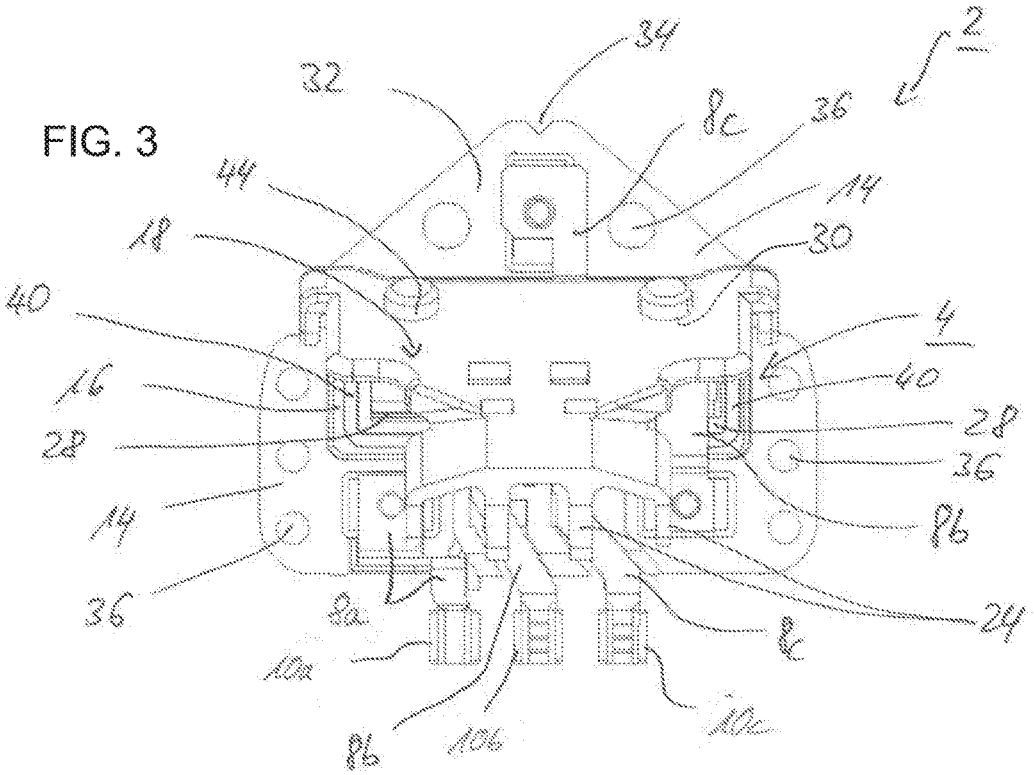
FIG. 3 is a top view of the plug bridge with the cover part open.

The crimp connections 10*a*, 10*b*, 10*c* project from an edge of the housing 16 and extend beyond the support plate 14. Therefore, the crimp connections are freely accessible both from the top and from the bottom when the cover part 18 is open, so that an automated crimping process for connecting conductor ends of a cable, not illustrated in any detail here, to the crimp connections 10*a*, 10*b*, 10*c* is possible in a simple manner. As is further shown in the figures, the cover part 18 not only covers and closes the housing 16, but rather also projects beyond the crimp connections 10*a*, 10*b*, 10*c* by way of a front sub region. In the sub region, separating webs 24 which project vertically downward and approximately in the form of fingers are integrally formed on the otherwise plate-like cover part 18, the separating webs engaging between the individual crimp connections 10*a, b, c* in the closed position, as is illustrated in FIG. 2. The two outer crimp connections 10*a*, 10*c* are also delimited at the edge by separating webs 24 of this kind. These separating webs 24 reliably prevent displacement of the crimp connections 10*a*,

10*b*, 10*c* during subsequent encapsulation of the plug bridge 2 by casting using a casting compound.

The housing 16 has an accommodation space, not illustrated in any detail here, which is open to the contact pins 6*a*, 6*b*, 6*c* at the bottom and into which a fuse element is inserted. The housing 16 closes the accommodation space at the top in the direction of the cover part 18 by way of a kind of intermediate base. Projecting side walls are formed above the intermediate base, the side walls delimiting two chambers 28 at the edge which are separated from one another by a central intermediate chamber.

The left-hand-side crimp connection 10*a* is connected to the contact pin 6*a* by the contact tab 8*a* at the front-left. The central crimp connection 10*b* is initially routed into the left-hand-side chamber 28 by the contact tab 8*b* via a guide channel which is formed through the housing 16. In this case, the contact tab 8*a* has a central region with a hole within the chamber 28, a fixing pin 30 passing through the hole. The fixing pin 30 is formed on the intermediate base of the housing 16. The contact tab 8*b* has two tabs which are bent at the edge and adjoin the central region and which make electrical contact with the inserted fuse element. In a corresponding manner, a further partial piece of the contact tab 8*b* is routed out of the electronic assembly again and connected to the contact pin 6*b* at the front-right in an identical manner in the right-hand-side chamber 28.

Finally, the right-hand-side crimp connection 10*c* is routed via a central guide channel by the intermediate chamber between the two chambers 28 beyond the housing 16 into the rear region of the plug bridge 2 and the rear contact pin 6*c* makes electrical contact with the right-hand-side crimp connection there.

In the rear region of the plug bridge 2, the support 4 forms a triangular edge region 32 with a flattened triangle tip in which a V-shaped notch 34 is made.

Furthermore, a plurality of passage holes 36 are made in the support plate 14. The passage holes and the V-shaped notch 34 are configured for the casting process in which the plug bridge 2 with the connected conductors is encapsulated by casting with a casting compound.

As is shown, in particular, in FIG. 1, sealing webs 38 are formed on the bottom face of the cover part 18, the sealing webs engaging into corresponding channels 40 which are made in the end of the side walls of the housing 16 which delimit the chambers 28. As is shown, in particular, in FIG. 1, the sealing webs 38 and, in a complementary manner, also the channels 40 run in a virtually closed circumferential manner around the respective chamber 28. The sealing webs 38 and the channels 40 are interrupted in the direction of the crimp connections 10*a*, 10*b*, 10*c* and form bushings for the individual sections of the contact tab 8*b*. The channels 40 exit at the rear side wall of the housing 16, so that they are of approximately U-shaped design overall and are open to the edge side.

As is further shown in the figures, the cover part 18 has apertures in the direction of the crimp connections 10*a*, 10*b*, 10*c* in a manner adjoining the sealing webs 38 and therefore adjoining the chambers 28. The apertures ensure that intermediate spaces between separating walls 42 of the support 4 are filled. In this case, the separating walls 42 adjoin the circumferential side wall of the housing 16 approximately at a right angle and are oriented in the direction of the crimp connections 10*a*, 10*b*, 10*c*. At the same time, the intermediate spaces between the separating walls 42 define guide spaces or guide channels for the contact tabs 8*b*, 8*c*. These separating walls 42 are continued by the separating webs 24 in the closed state.

Furthermore, hat-like caps 44 are formed in the cover part 18, the caps receiving the ends of the fixing pins 30 in an interlocking manner in the closed state.

In an expedient refinement, not illustrated in any detail here, the cover part 18 can be locked in the open position illustrated in FIG. 1, so that the cover part 18 is automatically held in this position. To this end, suitable a locking arrangement is formed, for example, in the region of the rotary articulation that is to say in the region of the bearing pins 20 and the bearing eyelets 22, so that the cover is held in this open position. This locking arrangement can be reversibly released by an action of force, so that the cover part 18 can be moved from the position which is illustrated in FIG. 1 to the closed position which is illustrated in FIG. 2. To this end, the cover part 18 is therefore pivoted about a pivot axis which is defined by the bearing pins 20.

Furthermore, an arrangement for locking or an arrangement for latching the cover part 18 to the housing 16 is also formed for the closed position. To this end, latching elements are preferably integrally formed on the bottom face of the cover part 18, the latching elements interacting with corresponding latching elements on the side walls of the housing 16.

The contact element 8*c* which is arranged on the outside right is only inserted loosely into the open housing 16 from above. In order to fix the contact element in its bottom desired mounting position, at least one interlocking element, in particular in the form of a latching element, is formed on the support 4 in a preferred refinement. To this end, two opposing latching lugs are preferably formed on the wall regions of the separating walls 42.

Figure 4:
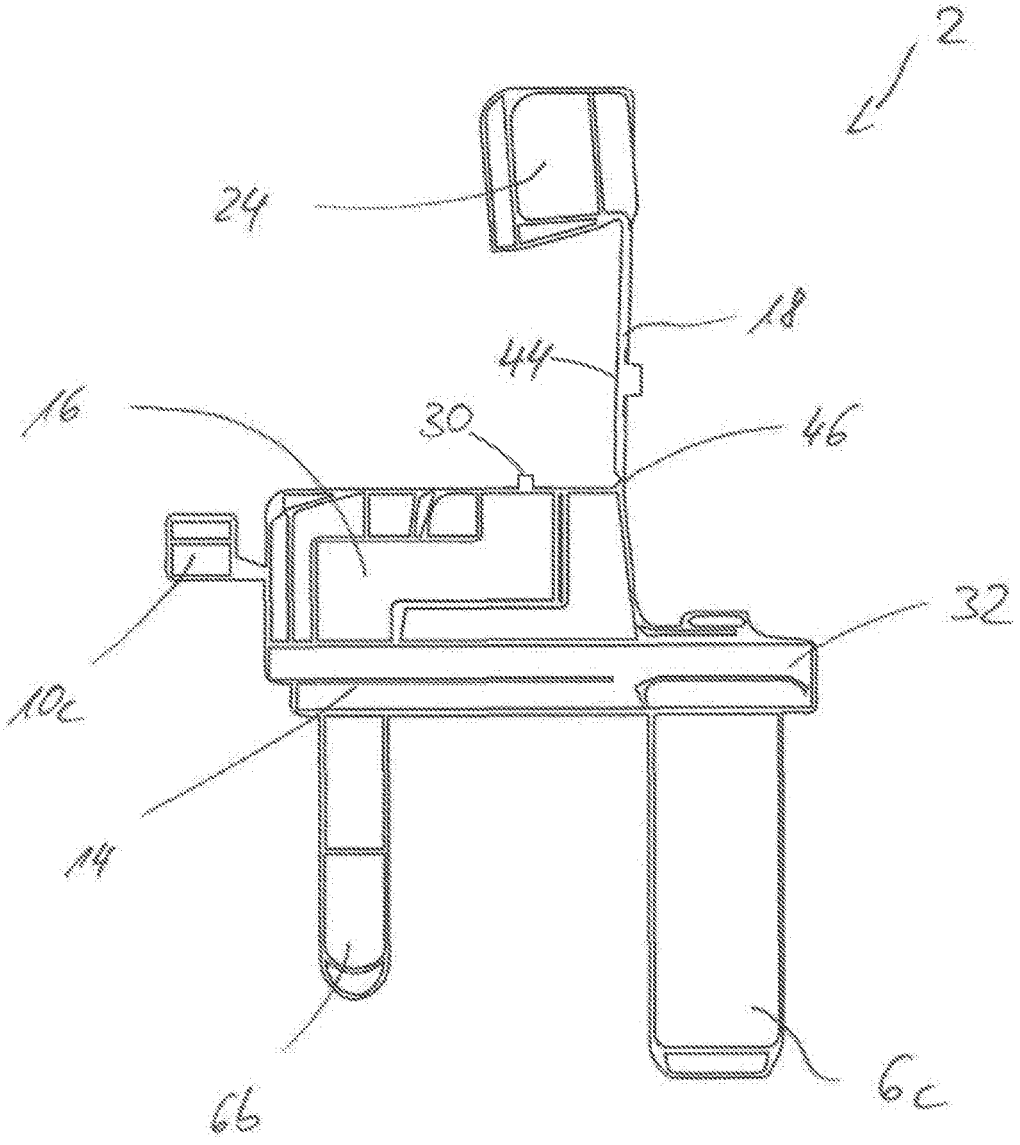
FIG. 4 is a side view of the plug bridge of a second variant embodiment when the cover part is open.

The second variant embodiment which is illustrated in FIG. 4 is distinguished by an integral configuration in which the cover part 18 is integrally formed directly on the housing 16. Therefore, the entire support 4, as a single-piece injection-molded part, also contains the cover part 18. In order to allow pivoting, a notch or tapered material portion which defines a pivot axis is formed in the transition region from the cover part 18 to the housing 16. A material bridge 46 with a reduced wall thickness in comparison to the rest of the cover part 18 therefore remains. In this case, the wall thickness of the material bridge 46 is dimensioned to be sufficiently thick, so that the cover part 18 is fixed in the open position shown in FIG. 4. In order to move to the closed position, an external closing force has to be applied to the cover part 18. The support 4 is prefabricated in the mounting situation illustrated in FIG. 4 and delivered to the crimping machine and inserted there. The cover part 18 is moved to the closed position only after the crimping process has taken place. The fixing of the material bridge 46 is irreversibly broken in the process. However, the material bridge 46 preferably further still forms a hinge articulation, so that the cover part 18 is still held on the housing 16 even after the fixing is broken.

In order to produce a mains contact plug, the plug bridge 2 which is illustrated in the figures is passed, in prefabricated form, to a mounting apparatus, in particular to a crimping machine. In this case, the plug bridge 2 is delivered in the closed position, which is shown in FIG. 2, for the purpose of reliable transportation. The cover part 18 is first moved to the open position. Conductor ends of the conductors which are to be connected are then inserted into the crimp connections 10*a*, 10*b*, 10*c*, and there crimped to the crimp tabs of the crimp connections 10*a*, 10*b*, 10*c* by being bent over. As a result, the cover part 18 is again moved to the closed position which is illustrated in FIG. 2, and preferably latched to the housing 16. In the last step, the plug bridge 2 together with the cable which is connected to it are finally further encapsulated by casting with a potting compound.

The following is a summary list of reference numerals and the corresponding structure used in the above description of the invention:

2 Plug bridge
4 Support
6*a, b, c* Contact pins
8*a, b, c* Contact tab
10*a, b, c* Crimp connection
14 Support plate
16 Housing
18 Cover part
20 Bearing pin
22 Bearing eyelet
24 Separating web
28 Chamber
30 Fixing pin
32 Triangular edge region
34 V-shaped notch
36 Passage hole
38 Sealing web
40 Channel
42 Separating walls
44 Hat-like cap
46 Material bridge

The invention claimed is:

1. A plug bridge for a mains plug, the plug bridge comprising:

a plurality of contact pins;

a plurality of conductor connections;

a support to which said plurality of contact pins and said plurality of conductor connections being fastened, said support having a housing with a plurality of chambers being separated from one another and said conductor connections disposed at an edge next to said housing;

contact tabs, one of said contact tabs electrically conductively connected to in each case one of said contact pins and adjoining one of said conductor connections;

a common dimensionally stable and inherently rigid cover part not having parts that move relative to one another, said cover part covering said housing and said conductor connections, in a closed state, said cover part having separating webs in a region of said conductor connections, said separating webs extending between said conductor connections in the closed state, and in that said cover part on said housing can pivot from an open position, in which said housing is open and said conductor connections are freely accessible, to the closed position such that, during a pivoting movement, said housing is closed and said separating webs are inserted between said conductor connections;

the plug bridge further including at least one articulation element integrally formed on said housing, and said cover part being snapped onto said articulation element, wherein said articulation element is an articulation pin integrally formed on either side of said housing;

said support including a support plate with passage holes formed in said support plate adjacent to said housing; and said support plate including at least one of:

a casting compound passing through said passage holes in a finally assembled state; or an end edge with at least one notch formed in said edge.

2. The plug bridge according to claim 1, wherein said cover part is formed in one piece with said housing.

3. The plug bridge according to claim 2, wherein said cover part is prefabricated with said housing as an injection-molded part in the open position, and said cover part is connected to said housing by a material bridge which fixes said cover part in the open position as an assembly position.

4. The plug bridge according to claim 1, wherein said cover part can be latched to said housing in the closed position for preventing pivoting.

5. The plug bridge according to claim 1, wherein said cover part can be latched to said housing in the open position for preventing pivoting.

6. The plug bridge according to claim 1, wherein said cover part has a bottom face with at least one first positioning element formed on said bottom face; and further comprising a second positioning element, said first positioning element engaging into said second positioning element in the closed position for defined positioning of said cover part relative to said housing.

7. The plug bridge according to claim 6, wherein said second positioning element is a fixing pin for one of said contact tabs associated with one of said conductor connections, said one contact tab being disposed in said housing.

8. The plug bridge according to claim 7, wherein said first positioning element is formed as a closed, hat-like cap.

9. The plug bridge according to claim 1, wherein said conductor connections have said contact tabs which are routed at least partially in or through said housing, wherein at least one of said contact tabs is held on said housing by said housing in an interlocking manner.

10. The plug bridge according to claim 1, wherein said housing and said cover part have, in a manner corresponding to one another, at least one channel and at least one sealing web which engages into said channel.

11. The plug bridge according to claim 10, wherein said housing forms said plurality of chambers with said cover part, and an at least virtually circumferential channel is associated with each of said chambers.

12. The plug bridge according to claim 1, wherein said cover part is connected to said housing in a circumferentially cohesive manner in a finally assembled state.

13. The plug bridge according to claim 1, wherein said cover part is mounted on said housing such that said cover part executes a linear movement in a region of the closed position.

14. A plug bridge for a mains plug, the plug bridge comprising:

a plurality of contact pins;

a plurality of conductor connections;

a support to which said plurality of contact pins and said plurality of conductor connections being fastened, said support having a housing with a plurality of chambers being separated from one another and said conductor connections disposed at an edge next to said housing;

contact tabs, one of said contact tabs electrically conductively connected to in each case one of said contact pins and adjoining one of said conductor connections;

a common dimensionally stable and inherently rigid cover part not having parts that move relative to one another, said cover part covering said housing and said conductor connections, in a closed state, said cover part having separating webs in a region of said conductor connections, said separating webs extending between said conductor connections in the closed state, and in that said cover part on said housing can pivot from an open position, in which said housing is open and said conductor connections are freely accessible, to the closed position such that, during a pivoting movement, said housing is closed and said separating webs are inserted between said conductor connections;

said cover part being prefabricated in one piece with said housing as an injection-molded part in the open position, and said cover part is connected to said housing by a material bridge which fixes said cover part in the open position as an assembly position; and wherein said support includes a support plate with passage holes formed in said support plate adjacent to said housing;

said support plate further comprising at least one of:

a casting compound passing through said passage holes in a finally assembled state; or an end edge with at least one notch formed therein.

15. A method for producing a plug with an aid of a plug bridge according to claim 1, which comprises the steps of:

connecting conductors to the conductor connections in the open position of the cover part;

moving the cover part to the closed position;

surrounding the plug bridge with a casting compound; and holding the cover part in a fixed manner in the open position as a mounting position by a material bridge.

16. A method for producing a plug with an aid of a plug bridge according to claim 14, which comprises the steps of:

connecting conductors to the conductor connections in the open position of the cover part;

moving the cover part to the closed position;

surrounding the plug bridge with a casting compound; and holding the cover part in a fixed manner in the open position as a mounting position by a material bridge.

* * * * *